US008950633B2

(12) United States Patent
Iizuka et al.

(10) Patent No.: US 8,950,633 B2
(45) Date of Patent: Feb. 10, 2015

(54) FOAM DISPENSER

(75) Inventors: Shigeo Iizuka, Tokyo (JP); Hiroshi Mizushima, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 8 days.

(21) Appl. No.: 13/997,776

(22) PCT Filed: Jan. 27, 2012

(86) PCT No.: PCT/JP2012/000538
§ 371 (c)(1),
(2), (4) Date: Jun. 25, 2013

(87) PCT Pub. No.: WO2012/105206
PCT Pub. Date: Aug. 9, 2012

(65) Prior Publication Data

US 2013/0313285 A1 Nov. 28, 2013

(30) Foreign Application Priority Data

Jan. 31, 2011 (JP) ..... 2011-019154
Oct. 31, 2011 (JP) ..... 2011-239493

(51) Int. Cl.
*B67D 7/76* (2010.01)
*A47K 5/14* (2006.01)
(Continued)

(52) U.S. Cl.
CPC ..... *A47K 5/14* (2013.01); *B05B 7/0037* (2013.01); *B05B 11/3004* (2013.01); *B05B 11/3069* (2013.01); *B05B 11/3087* (2013.01)
USPC ..... 222/190; 222/321.9

(58) Field of Classification Search
CPC .. B05B 7/0018; B05B 7/005; B05B 11/0016; B05B 11/0021; B05B 11/3066; B05B 11/3087; B05B 7/0037; B05B 11/3069; B05B 11/3004; A47K 5/14
USPC ..... 222/190, 320–321.9; 239/355–363, 239/366, 333; 92/184, 181 P
See application file for complete search history.

(56) References Cited

U.S. PATENT DOCUMENTS 5,271,530 A * 12/1993 Uehira et al. ..... 222/190
5,462,208 A * 10/1995 Stahley et al. ..... 222/207
(Continued)

FOREIGN PATENT DOCUMENTS

DE 199 57 739 A1 6/2001
JP A-9-183447 7/1997
(Continued)

OTHER PUBLICATIONS

International Search Report issued in International Patent Application No. PCI/JP2012/000538 dated May 1, 2012.

*Primary Examiner* — Patrick M Buechner
(74) *Attorney, Agent, or Firm* — Oliff PLC

(57) ABSTRACT

Provided is a foam dispenser that is capable of preventing water or the like from entering an air cylinder. In the foam dispenser, a liquid piston is fitted in a liquid cylinder portion, and an air piston is fitted in an air cylinder portion, and upward and downward displacement of the actuator causes a content liquid within the liquid cylinder portion and air within the air cylinder portion to be mixed and foamed and then dispensed from a nozzle, and a partition wall is provided with an ambient air introducing hole, and from at least a portion of a hole periphery of the ambient air introducing hole, a water entering prevention side wall portion stands for preventing water from entering the ambient air introducing hole.

10 Claims, 11 Drawing Sheets

(51) Int. Cl.
*B05B 7/00* (2006.01)
*B05B 11/00* (2006.01)

(56) References Cited

U.S. PATENT DOCUMENTS

| | | | | | |
|---|---|---|---|---|---|
| 5,570,819 | A * | 11/1996 | Uehira et al. | ..... | 222/190 |
| 5,813,576 | A * | 9/1998 | Iizuka et al. | ..... | 222/190 |
| 6,119,899 | A * | 9/2000 | Iizuka et al. | ..... | 222/190 |
| 6,536,629 | B2 * | 3/2003 | van der Heijden | ..... | 222/190 |
| 6,793,100 | B2 * | 9/2004 | Iizuka et al. | ..... | 222/145.5 |
| 7,201,293 | B2 * | 4/2007 | Iizuka et al. | ..... | 222/145.6 |
| 7,275,661 | B2 * | 10/2007 | Iizuka et al. | ..... | 222/145.6 |
| 7,850,048 | B2 * | 12/2010 | Arminak | ..... | 222/190 |
| 8,225,965 | B2 * | 7/2012 | Arminak | ..... | 222/190 |
| 8,292,127 | B2 * | 10/2012 | van Der Heijden | ..... | 222/190 |
| 2002/0000452 | A1 * | 1/2002 | Iizuka et al. | ..... | 222/190 |
| 2002/0056730 | A1 * | 5/2002 | van de Heijden | ..... | 222/190 |
| 2003/0080157 | A1 * | 5/2003 | Iizuka et al. | ..... | 222/190 |
| 2005/0029302 | A1 * | 2/2005 | Iizuka et al. | ..... | 222/190 |
| 2006/0219738 | A1 | 10/2006 | IIzuka et al. | | |
| 2007/0151985 | A1 * | 7/2007 | Iizuka et al. | ..... | 222/190 |
| 2007/0170206 | A1 * | 7/2007 | Iizuka et al. | ..... | 222/190 |
| 2008/0093386 | A1 * | 4/2008 | Arminak | ..... | 222/190 |
| 2009/0008412 | A1 * | 1/2009 | Choi et al. | ..... | 222/190 |
| 2009/0020552 | A1 * | 1/2009 | van der Heijden | ..... | 222/1 |
| 2009/0206109 | A1 * | 8/2009 | Santagiuliana | ..... | 222/190 |
| 2009/0266846 | A1 * | 10/2009 | Iizuka | ..... | 222/190 |
| 2011/0031276 | A1 * | 2/2011 | Mizushima et al. | ..... | 222/190 |
| 2012/0241477 | A1 * | 9/2012 | Uehira et al. | ..... | 222/190 |
| 2012/0285994 | A1 * | 11/2012 | Arminak | ..... | 222/190 |
| 2013/0043278 | A1 * | 2/2013 | Tu | ..... | 222/190 |

FOREIGN PATENT DOCUMENTS

| | | |
|---|---|---|
| JP | A-2007-253113 | 10/2007 |
| JP | A-2010-265009 | 11/2010 |
| KR | 10-2010-0137407 A | 12/2010 |
| WO | WO 2005/080003 A1 | 9/2005 |

* cited by examiner (a)

(b)

(a)

(b)

FOAM DISPENSER

TECHNICAL FIELD

The present inventions relates to a foam dispenser that mixes air and liquid and dispenses the mixture of air and liquid as fine-textured foam.

BACKGROUND ART

As a conventional technique, a foam dispenser is known that includes a placing tubular portion adapted to be fitted to a neck of a container body, and a standing tubular portion standing from an inner circumference of a flange-shaped top wall portion of the placing tubular portion. In this instance, an air cylinder is suspended from the flange-shaped top wall portion, and a tubular air piston is fitted in the air cylinder. The air piston has a partition wall provided with an ambient air introducing hole, and the partition wall of the air piston is slidably inserted in the air cylinder. A nozzle head is also placed over a stem standing from a liquid cylinder. (Refer to JP2007-253113A, for example.)

SUMMARY OF THE INVENTION

Technical Problem

However, in the conventional technique, there is a problem that water and the like that has entered the standing tubular portion can drip on the partition wall of the air piston and enter the air cylinder through the ambient air introducing hole.

The present invention has been conceived in order to solve the problem and aims to provide a foam dispenser that is capable of preventing water and the like from entering the air cylinder.

Solution to Problem

A first aspect of the present invention resides in a foam dispenser, comprising: a placing member 20 that includes a placing tubular portion 21 adapted to be fitted to an outer surface of a neck 12 of a container 10 and an inwardly directed flange-shaped top wall portion 22 provided in an upper portion of the placing tubular portion 21; a cylinder 30 that includes a lower portion and an upper portion and that is suspended from a lower surface of the inwardly directed flange-shaped top wall portion 22 into the container 10, the lower portion of the cylinder 30 being formed as a small-diameter liquid cylinder portion 30*a* and the upper portion of the cylinder being formed as an air cylinder portion 30*b*, the air cylinder portion 30*b* having a larger diameter than the small-diameter liquid cylinder portion 30*a*; and an actuator A that includes a liquid piston 41 adapted to slide in the liquid cylinder portion 30*a*, a stem 60 standing from the cylinder 30, a ring-shaped partition wall 72 surrounding a middle portion of the stem 60 in a vertical direction thereof, an air piston 73 provided on an outer circumferential portion of the partition wall 72, and a depression head 80 placed over the stem 60 and including a nozzle 83, wherein the liquid piston 41 is slidably fitted in the liquid cylinder portion 30*a*, and the air piston 73 is slidably fitted in the air cylinder portion 30*b*, and upward and downward displacement of the actuator A causes a content liquid within the liquid cylinder portion 30*a* and air within the air cylinder portion 30*b* to be mixed and foamed and then dispensed from the nozzle 83, and the partition wall 72 is provided with an ambient air introducing hole 76, and from at least a portion of a hole periphery of the ambient air introducing hole 76, a water entering prevention side wall portion 77 stands for preventing water from entering the ambient air introducing hole 76.

A second aspect of the present invention resides in a foam dispenser according to the first aspect, wherein the water entering prevention side wall portion 77 is formed on an outer side of the hole periphery of the ambient air introducing hole 76 in a radial direction of the partition wall 72, and a vent hole 76*a* is provided on an inner side in the radial direction.

A third aspect of the present invention resides in a foam dispenser according to the first aspect, wherein a water entering prevention top wall portion 78 is attached to an upper end portion of the water entering prevention side wall portion 77, the water entering prevention top wall portion 78 extending inward in the radial direction of the partition wall 72 in a roof-like shape from the water entering prevention side wall portion 77 as seen in a longitudinal sectional view in a circumferential direction of the ring-shaped partition wall 72.

A fourth aspect of the present invention resides in a foam dispenser according to the first aspect, wherein the water entering prevention side wall portion 77 is formed in a tubular shape, and the vent hole 76*a* is provided on an upper side of a half portion of the tubular shape of the water entering prevention side wall that is located on the inner side in the radial direction of the partition wall 72.

A fifth aspect of the present invention resides in a foam dispenser according to the first aspect, wherein the inwardly directed flange-shaped top wall portion 22 includes a flange hole 26 from which a suspended tubular portion 24 is suspended, and the ambient air introducing hole 76 is provided outward of the suspended tubular portion 24 in the radial direction of the partition wall 72, and the vent hole 76*a* is located above a lower end of the suspended tubular portion 24.

A sixth aspect of the present invention resides in a foam dispenser according to the first aspect, wherein the inwardly directed flange-shaped top wall portion 22 includes a flange hole 26 from which a suspended tubular portion 24 is suspended, and the ambient air introducing hole 76 is provided outward of the suspended tubular portion 24 in the radial direction of the partition wall 72.

A seventh aspect of the present invention resides in a foam dispenser according to the first aspect, wherein the water entering prevention side wall portion 77 is formed in a C-shape in an entirety of the hole periphery of the ambient air introducing hole 76 except for a portion of the hole periphery that is on the outer side in the radial direction of the partition wall 72.

An eighth aspect of the present invention resides in a foam dispenser according to the first aspect, wherein the water entering prevention side wall portion 77 is formed in an entirety of the hole periphery of the ambient air introducing hole 76.

An ninth aspect of the present invention resides in a foam dispenser according to the first aspect, wherein the water entering prevention side wall portion 77 standing from an inner side of the hole periphery of the ambient air introducing hole 76 has a middle portion that is bent toward the suspended tubular portion 24 in a convex shape.

A tenth aspect of the present invention resides in a foam dispenser according to the first aspect, wherein the ambient air introducing hole 76 is formed in an outer circumferential portion of a top surface wall of the partition wall 72.

A eleventh aspect of the present invention resides in a foam dispenser according to the first aspect, wherein an upper end of the water entering prevention side wall portion 77 is located above the lower end of the suspended tubular portion 24 in an uppermost displacement position of the stem 60.

Advantageous Effects of Invention

According to the present invention, provision of the water entering prevention side wall portion 77 standing from the at least a portion of the hole periphery of the ambient air introducing hole 76 ensures that water is prevented from entering the ambient air introducing hole 76.

Furthermore, by forming the water entering prevention side wall portion 77 on the outer side of the hole periphery of the ambient air introducing hole 76 in the radial direction of the partition wall 72 and providing a vent hole 76*a* on the inner side in the radial direction, even when the foam dispenser is tilted, water is prevented from entering the ambient air introducing hole 76. As a result, the foam dispenser is well-suited for handy usage.

BRIEF DESCRIPTION OF DRAWINGS

The present invention will be further described below with reference to the accompanying drawings, wherein.

DESCRIPTION OF EMBODIMENTS (First Embodiment)

Figure 1:
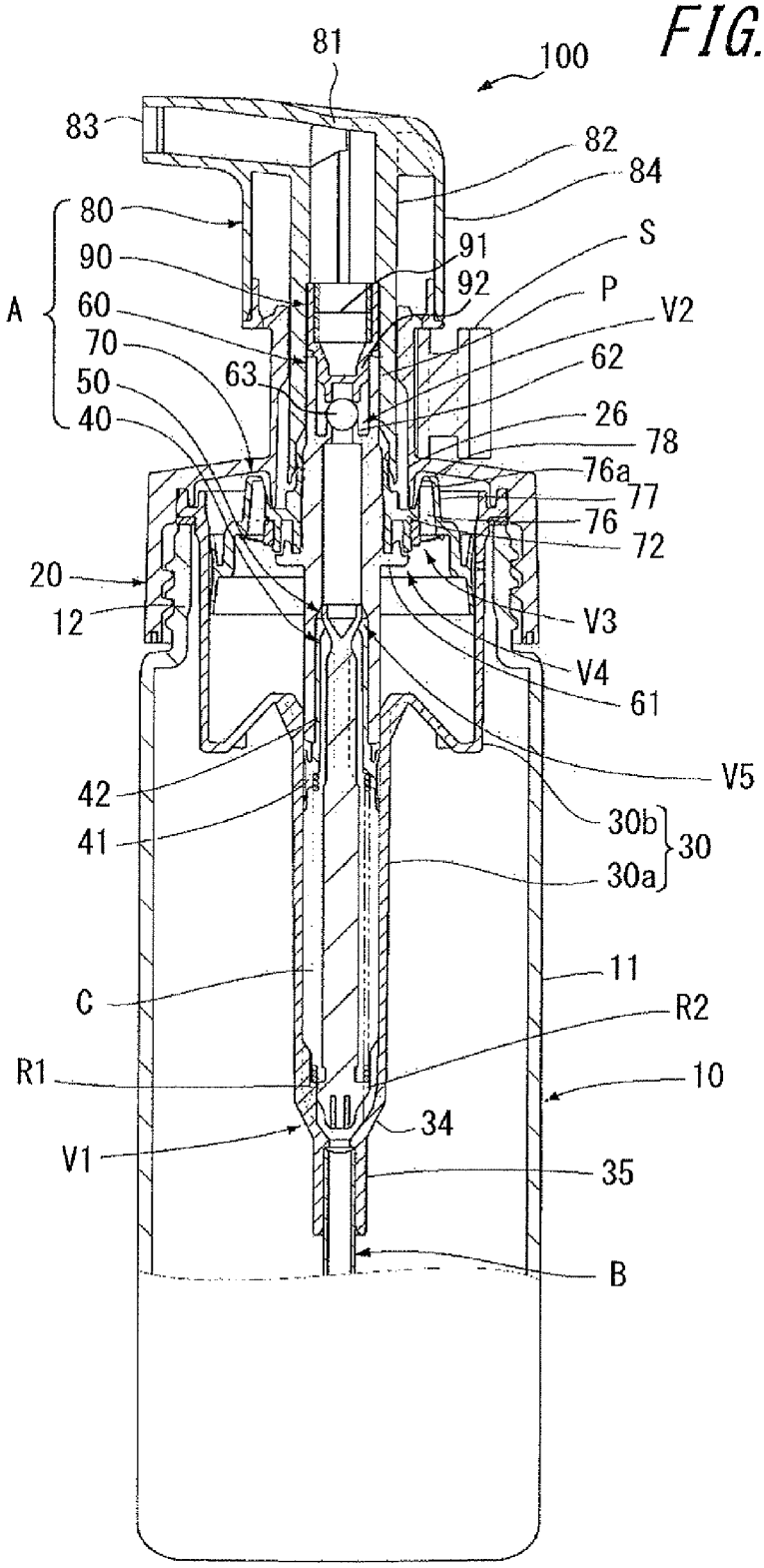
FIG. 1 is a longitudinal sectional view of a foam dispenser according to a first embodiment of the present invention.
Figure 2:
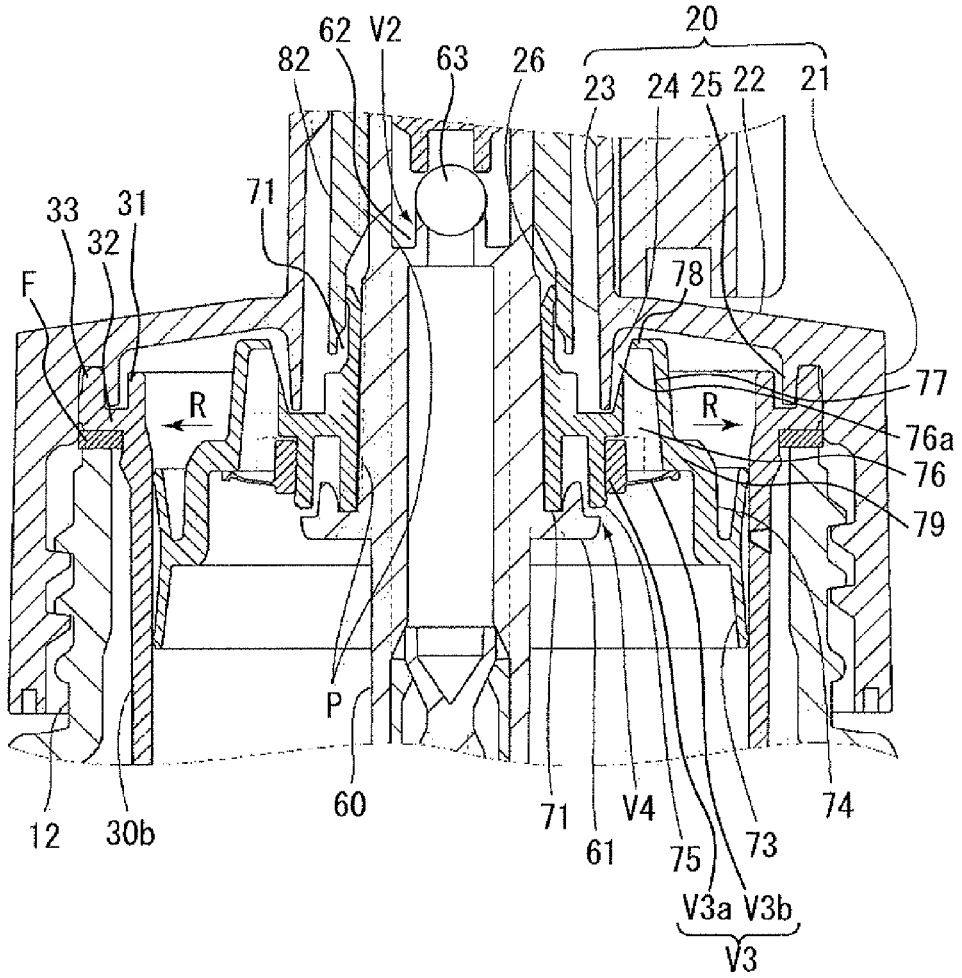
FIG. 2 is a longitudinal sectional view of a part of the foam dispenser shown in FIG. 1.

FIGS. 1-4 show a foam dispenser 100 according to a first embodiment of the present invention. Firstly, with reference to FIGS. 1 and 2, a description is given of a structure of the foam dispenser of the first embodiment.

The foam dispenser 100 of the first embodiment includes a placing member 20, a cylinder 30, and an actuator A (having a first piston member 40, a poppet valve body 50, a stem 60, a second piston member 70, a depression head 80, and a foaming tube 90) which are connected to a container body 10. In other words, the foam dispenser 100 does not include the container body 10. Furthermore, a spacer S is attached to the foam dispenser 100. Besides, the above components are made of synthetic resin materials unless otherwise specified.

The container body 10 includes a graspable trunk 11 and a wide neck 12 standing from the trunk 11.

The placing member 20 includes a placing tubular portion 21, an inwardly directed flange-shaped top wall portion 22, a standing tubular portion 23, a suspended tubular portion 24, and a fitting tubular portion 25.

The placing tubular portion 21 is fitted (screw-fitted in the example shown in the figures) to an outer surface of the neck 12.

The inwardly directed flange-shaped top wall portion 22 is attached to an upper end of the placing tubular portion 21.

The standing tubular portion 23 protrudes upward from a flange hole 26 of the inwardly directed flange-shaped top wall portion 22 and extends into an inside of the depression head 80 which is later described. The standing tubular portion 23 is provided for guiding upward and downward displacement of the actuator A. As in a second embodiment which is described later, the standing tubular portion 23 may be omitted.

The suspended tubular portion 24 is suspended from the flange hole 26 of the inwardly directed flange-shaped top wall portion 22. In the example shown in the figures, the standing tubular portion 23 is extended downward in a tubular leg shape, and the extended portion is the suspended tubular portion 24. The suspended tubular portion 24 is provided for, when water has inevitably entered an inside of the standing tubular portion 23, guiding the water to pass along an inner surface of the suspended tubular portion 24 to flow toward a partition wall 72 which is later described, so that the water is prevented from flowing to a lower (back) surface of the inwardly directed flange-shaped top wall portion 22. The suspended tubular portion 24 prevents a waterdrop from dripping from the lower surface of the inwardly directed flange-shaped top wall portion 22 into an ambient air introducing hole 76 which is later described.

The fitting tubular portion 25 is suspended from an outer circumferential side of the lower surface of the inwardly directed flange-shaped top wall portion 22.

The cylinder 30 has an upper portion coupled to the fitting tubular portion 25 so as to be suspended from the lower surface of the inwardly directed flange-shaped top wall portion 22 into the container body 10. In the preferred example shown in the figures, a short tube 33 stands from an upper end portion 31 of the cylinder 30 via an outward flange 32. The flange 32 is mounted to an upper end of the neck 12 via a packing F. The engagement tubular portion 25 is inserted between the upper end portion 31 and the short tube 33.

A lower portion of the cylinder 30 is formed as a small-diameter liquid cylinder portion 30*a*, and an upper portion of the cylinder 30 is formed as an air cylinder portion 30*b* having a larger diameter than the liquid cylinder portion 30*a*. A lower portion of the liquid cylinder portion 30*a* is formed as a taper-shaped reduced-diameter portion 34 whose diameter is reduced toward a bottom thereof. From the reduced-diameter portion 34, an attachment tubular portion 35 is suspended. The attachment tubular portion 35 is fitted with a suction tube B. The liquid cylinder portion 30*a* also includes a plurality of first longitudinal ribs R1 circumferentially provided at intervals in an area from the reduced-diameter portion 34 to neighboring cylindrical wall portion. Upper surfaces of the first longitudinal ribs R1 serve as coil spring abutment portions.

The first piston member 40 includes a lower portion inserted and fitted into the cylinder 30. The first piston member 40 includes a liquid piston 41 slidably fitted to the liquid cylinder portion 30*a* and a stem fitting tubular portion 42 standing from the liquid piston 41. Between a lower portion of the first piston member 40 and the first longitudinal ribs R1 of the liquid cylinder portion 30*a*, a coil spring C is interposed.

The poppet valve body 50 is a spread end portion formed by spreading an upper end portion of a vertical valve bar 51 in a tapered shape whose diameter is increased toward a top thereof. The spread end portion is detachably locked to an upper end portion of the stem fitting tubular portion 42 such that the spread end portion and the upper end portion of the stem fitting tubular portion 42 together form a check valve V5.

There are also provided along an outer circumference of a lower portion of the poppet valve body 50 a plurality of longitudinal ribs R2 each interposed between adjacent ones of the first longitudinal ribs R1. In a state shown in FIG. 1, each second longitudinal ribs R2 is configured to be lockable at an upper end thereof to a lower end of the coil spring C. The poppet valve body 50 is adapted to be displaceable upward and downward between a position where the second longitudinal rib R2 comes into abutment with the lower end of the coil spring C and a position where the second longitudinal rib R2 comes into abutment with an inner surface (valve seat surface) of a lower end portion of the reduced-diameter portion 34. A lower end portion of the poppet valve body 50 and the reduced-diameter portion 34 of the cylinder 30 together form a liquid suction valve V1.

The stem 60 stands from an inside of the cylinder 30. More specifically, the stem 60 stands inside the standing tubular portion 23 while a lower end portion of the stem 60 is fitted around an outer surface of the stem fitting tubular portion 42. On the outer surface of a middle portion of the stem 60 in a vertical direction thereof, a flange-shaped first valve seat portion 61 is circumferentially provided. On an inner surface of an upper portion of the stem 60, an inwardly directed flange-shaped second valve seat portion 62 is also circumferentially provided, and a ball valve 63 is mounted on the second valve seat portion 62. The second valve seat portion 62 and the ball valve 63 together form a liquid dispensing valve V2.

The second piston member 70 includes a ring-shaped sliding tubular portion 71 fitted to the outer surface of the stem 60, the ring-shaped partition wall 72 extending radially outward of the sliding tubular portion 71, and an air piston 73 provided around an outer circumferential portion of the partition wall 72 and slidably fitted in the air cylinder portion 30*b*. The partition wall 72 surrounds the middle portion of the stem 60 in the vertical direction thereof, and the partition wall 72 extends from a middle portion of the sliding tubular portion 71 in a vertical direction thereof to a middle portion of the air piston 73 in a vertical direction thereof.

An outer circumferential portion of the partition wall 72 constitutes an outer circumferential wall 74 that extends upward from the middle portion of the air piston 73 in the vertical direction thereof. From a position inward of a middle portion of the partition wall 72 in a radial direction thereof, an inner circumferential wall 75 is suspended. The ambient air introducing hole 76 is provided in a portion of the partition wall 72 outward of both the inner circumferential wall 75 and the suspended tubular portion 24 in the radial direction.

A water entering prevention side wall portion 77 stands from a hole periphery of the ambient air introducing hole 76. In the example shown in the figures, the water entering prevention side wall portion 77 stands from an entirety of the hole periphery and therefore, the water entering prevention side wall portion 77 is formed in a tubular shape. There is also provided a vent hole 76*a* in an upper portion of a half portion of the tubular shape of the water entering prevention side wall portion 77 on an inner side in the radial direction of the partition wall 72 (which is opposite to a direction of an arrow R).

A water entering prevention top wall portion 78 is attached to the water entering prevention side wall portion 77. The water entering prevention top wall portion 78 is coupled to an upper end of the water entering prevention side wall portion 77. The water entering prevention top wall portion 78 extends radially inward in a roof-like shape from a half portion of the tubular shape of the water entering prevention side wall portion 77 that is located on an outer side in the radial direction, as seen in a longitudinal sectional view in a circumferential direction of the ring-shaped partition wall.

Between the inner circumferential wall 75 and the outer circumferential wall 74, there is formed an air suction valve V3 including a valve tube V3*a* and an elastic valve plate V3*b*. The valve tube V3*a* is fitted to the inner circumferential wall 75. The elastic valve plate V3*b* protrudes from an outer circumferential surface of the valve tube V3*a*. In the example shown in the figures, a horizontal portion located between the water entering prevention side wall portion 77 and the outer circumferential wall 74 of the partition wall 72 is formed as a stepped portion 79 that is lower than a horizontal portion located radially inward of the ambient air introducing hole 76 of the partition wall 72. The air suction valve V3 is formed by the elastic valve plate V3*b* abutting against a lower surface of the stepped portion 79.

Furthermore, an air dispensing valve V4 is formed by the sliding tubular portion 71, which is displaceable upward and downward relative to the stem 60, abutting at a lower portion thereof against an upper surface of the first valve seat portion 61 of the stem 60.

The depression head 80 includes a top wall 81, a coupling tubular portion 82, a nozzle 83, and a head circumferential wall 84. The coupling tubular portion 82 is suspended from a middle portion of a lower surface of the top wall 81 so as to be coupled to the upper portion of the stem 60. A lower portion of the coupling tubular portion 82 is in liquid-tight slidable abutment with an outer surface of an upper portion of the sliding tubular portion 71. The nozzle 83 communicates with an inside of the coupling tubular portion 82 and protrudes to a lateral outer side. The head circumferential wall 84 is suspended from an outer circumferential portion of the top wall 81 of the depression head 80, and the nozzle 83 penetrates one side of the head circumferential wall 84.

Between an inner surface of the sliding tubular portion 71 and the outer surface of the stem 60 facing thereto, and between an inner surface of the coupling tubular portion 82 and the outer surface of the stem 60 facing thereto, ribs and the like are longitudinally provided on the outer surfaces as indicated by dotted lines, and thus, an air passage P is formed. The air passage P allows the inside of the air cylinder portion 30*b* to be in communication with an air-liquid mixing chamber which is later described.

The foaming tube 90 is disposed on an upper end portion of the stem 60 and the coupling tubular portion 82. A portion of an inside of the stem 60 between the foaming tube 90 and the ball valve 63 is the air-liquid mixing chamber. The foaming tube 90 includes a foaming mesh 91 and a jet ring 92. There are an appropriate number of foaming meshes 91 horizontally provided for turning an air-liquid mixture into fine-textured foam. The jet ring 92 is also fitted at a lower portion thereof to the stem 60 in the air-liquid mixing chamber and fitted at an upper portion thereof to the inner surface of the coupling tubular portion 82 of the depression head 80.

The spacer S is interposed between the depression head 80 and the inwardly directed flange-shaped top wall portion 22.

Secondly, with reference to FIGS. 1-4, explanation is given of how the foam dispenser 100 of the first embodiment is operated.

From an initial state shown in FIG. 1, the spacer S is removed and the depression head 80 is depressed. Then, the first piston member 40, the poppet valve body 50, and the stem 60 are displaced downward. In this regard, since the sliding tubular portion 71 is slidable relative to the coupling tubular portion 82, the second piston member 70 remains stationary or displaced downward less than the stem 60 (i.e. displaced upward relative to the stem 60) in response to the initial depression of the depression head 80. Consequently, a lower end portion of the sliding tubular portion 71 is displaced off the first valve seat portion 61, and the air dispensing valve V4 is opened.

When the depression head 80 is further depressed, a lower end of the coupling tubular portion 82 comes into abutment with the partition wall 72, and the second piston member 70 is displaced downward. As a result, an air within the air cylinder portion 30*b* is pressurized. The pressurized air flows from the air dispensing valve V4, through a gap between the inner surface of the sliding tubular portion 71 and the outer surface of the stem 60 and a gap between the inner surface of the coupling tubular portion 82 and the outer surface of the stem 60 (which correspond to the aforementioned air passage P), and subsequently through a gap between an upper end surface of the stem 60 and the corresponding surface of the jet ring 92 and a gap between an inner surface of the upper end portion of the stem and the corresponding surface of the jet ring 92, into the air-liquid mixing chamber in the stem 60.

Furthermore, when the depression head 80 is depressed, the first piston member 40 is displaced downward, and in conjunction with this downward displacement, the poppet valve body 50 is displaced downward via the coil spring C until the poppet valve body 50 comes into abutment with the valve seat surface of the liquid cylinder portion 30*a*. When, after the downward displacement of the poppet valve body 50 ends, the first piston member 40 is displaced downward, an upper end of the stem fitting tubular portion 42 is displaced off the tapered tube of the poppet valve body 50 that has a diameter reduced toward a bottom thereof. As a result, the check valve V5 is opened. In this regard, the downward displacement of the first piston member 40 pressurizes a liquid within the liquid cylinder portion 30*a*. The pressurized liquid flows into the air-liquid mixing chamber through the check valve V5 and the liquid dispensing valve V2. In the air-liquid mixing chamber, the air and the liquid is mixed. The air-containing liquid passes through the foaming tube 90 to be foamed, and the foam is dispensed from the nozzle 83.

As described above, in the foam dispenser 100 of the first embodiment, the upward and the downward displacement of the actuator A causes the liquid within the liquid cylinder portion 30*a* and the air within the air cylinder portion 30*b* to be mixed and foamed, and then dispensed from the nozzle 83.

When the depressed depression head 80 is released, first of all, the first piston member 40, the poppet valve body 50, and the stem 60 are displaced upward by an urging force of the coil spring C. In this regard, the stem 60 is displaced upward relative to the second piston member 70, and the first valve seat portion 61 comes into abutment with the lower end portion of the sliding tubular portion 71. Accordingly, the air dispensing valve V4 is closed. Then, the second piston member 70 is displaced upward, and the air cylinder portion 30*b* assumes the negative pressure. As a result, the air suction valve V3 is opened to thereby introduce the outer air into the air cylinder portion 30*b*.

Due to the upward displacement of the stem 60, the poppet valve body 50 is displaced upward by a friction force with the stem 60, and the liquid suction valve V1 is opened. As a result, the liquid within the container body 10 is introduced into the liquid cylinder portion 30*a* which is under the negative pressure. In this regard, the liquid suction valve V2 is closed. The poppet valve body 50 is displaced upward until the second longitudinal ribs R2 come into abutment with the lower surface of the coil spring C, and subsequently, the poppet valve body 50 is displaced downward relative to the stem 60 until the spread end portion of the poppet valve body 50 comes into abutment with the upper end portion of the stem fitting tubular portion 42.

Although in the first embodiment the water entering prevention side wall portion 77 stands from the entirety of the hole periphery of the ambient air introducing hole 76, it is possible to prevent water from entering the ambient air introducing hole 76 even when the water entering prevention side wall portion 77 stands from at least a portion of the hole periphery of the ambient air introducing hole 76.

Figure 3:
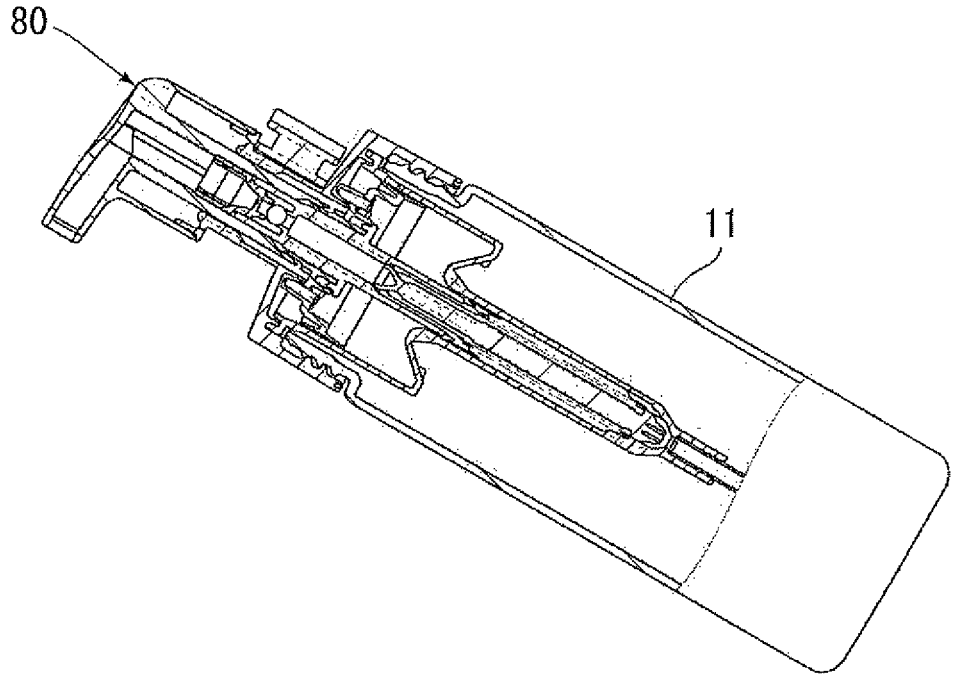
FIG. 3 shows the foam dispenser shown in FIG. 1 in a state where it is tilted during use.
Figure 4:
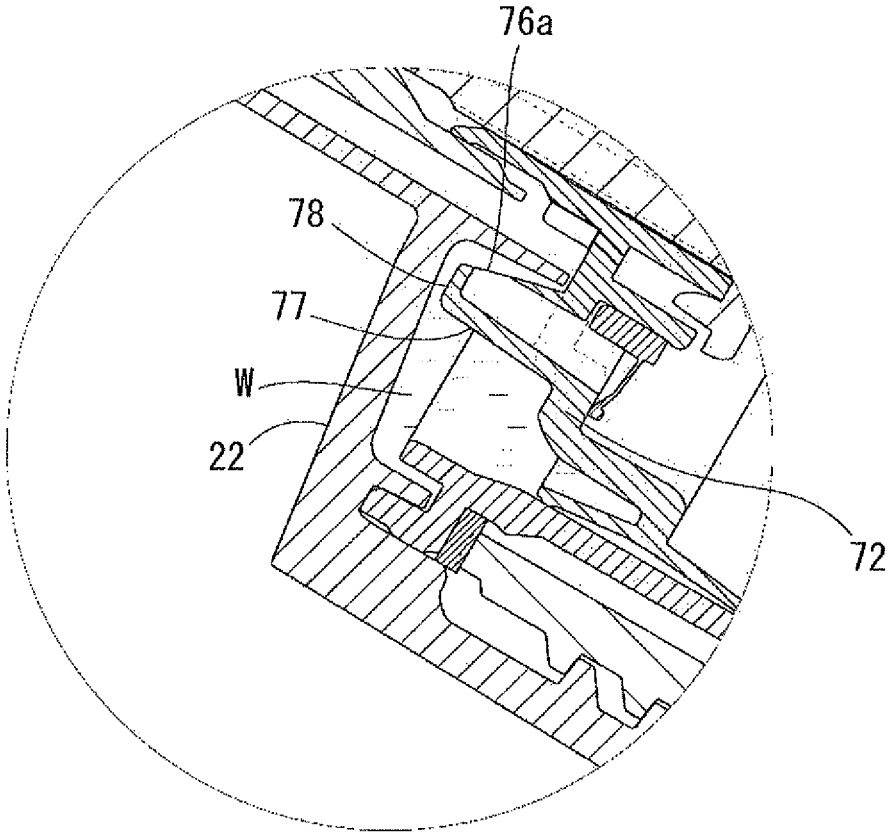
FIG. 4 is a partially enlarged view of the foam dispenser in the state shown in FIG. 3.
Figure 5:
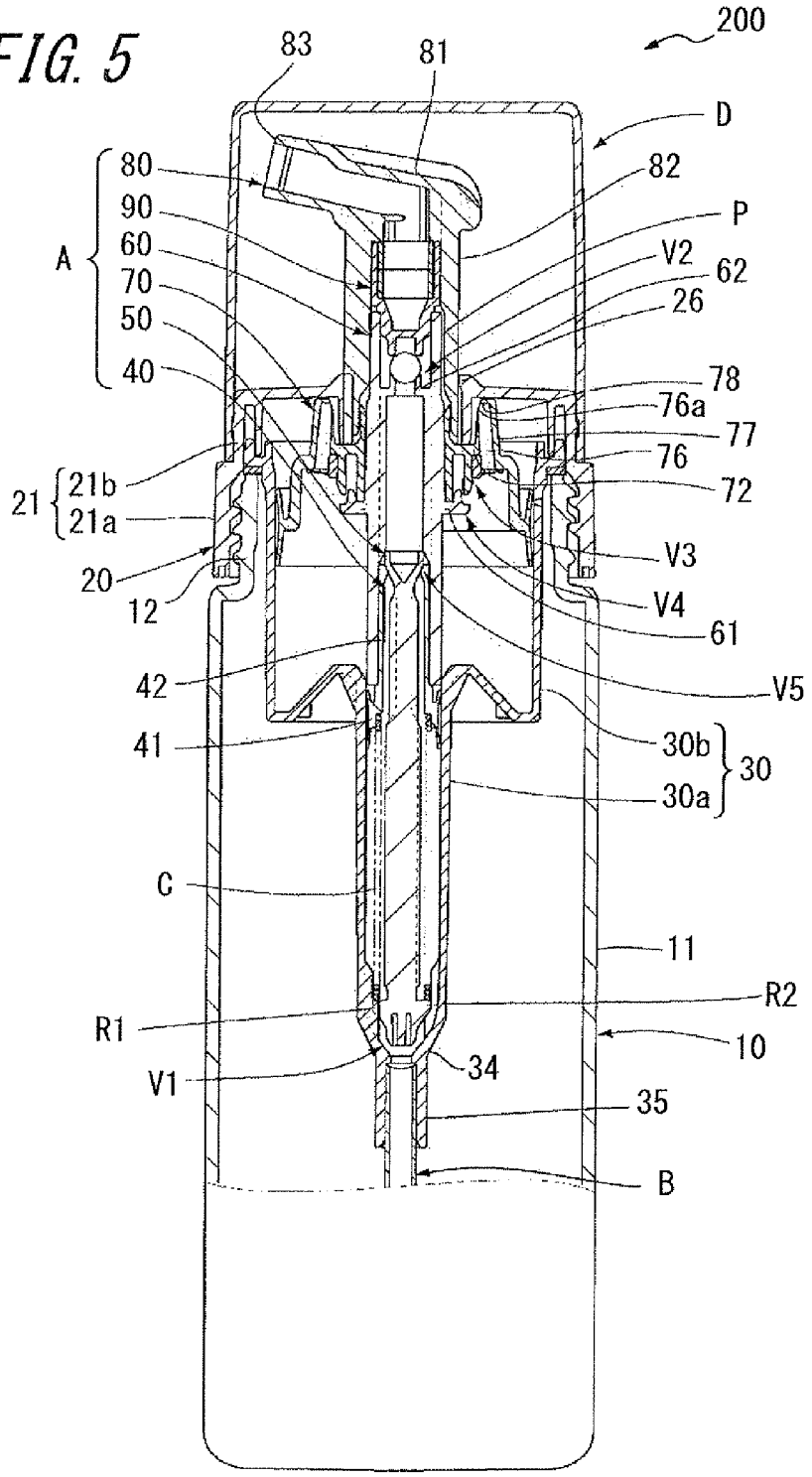
FIG. 5 is a longitudinal sectional view of the foam dispenser according to a second embodiment of the present invention.
Figure 6:
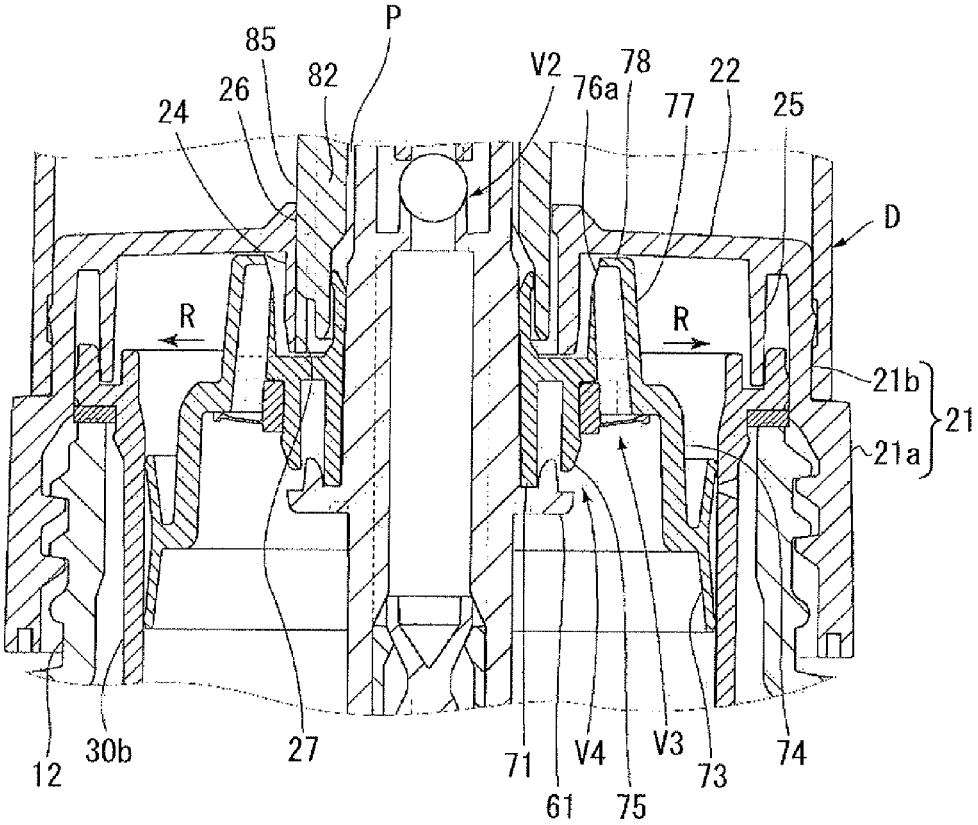
FIG. 6 is a longitudinal sectional view of a part of the foam dispenser shown in FIG. 5.

In this regard, it is preferable that the water entering prevention side wall portion 77 is formed on the outer side of the hole periphery of the ambient air introducing hole 76 in the radial direction of the partition wall 72, and a vent hole 76*a* is provided on the inner side in the radial direction. In this case, the water entering prevention side wall portion 77 surrounds three sides of the ambient air introducing hole 76, in other words, the outward (which is indicated by the arrow R in FIG. 2) in the radial direction of the partition wall 72, and circumferential direction (which corresponds to front and back in FIG. 2) orthogonal to the direction indicated by arrow R. By surrounding the three sides, the water entering prevention side wall portion 77 prevents, when the foam dispenser 100 is tilted as shown in FIGS. 3 and 4, entering of water W collected in a lowered portion within a gap between the partition wall 72 and the inwardly directed flange-shaped top wall portion 22 into the ambient air introducing hole 76. Accordingly, the foam dispenser 100 is well-suited for handy usage.

In the first embodiment, the water entering prevention top wall portion 78 is preferably provided because the water entering prevention top wall portion 78 prevents water from entering from an upper end side of the water entering prevention side wall portion 77 even when the foam dispenser 100 is tilted further than the state shown in FIG. 4.

Unlike the first embodiment, the similar water entering prevention effect is achieved by lengthening the water entering prevention side wall portion 77 while the water entering prevention top wall portion 78 is omitted. However, by doing so, a longitudinal width of the second piston member 70 is increased, and a larger space is required for housing the second piston member 70. Provision of the water entering prevention top wall portion 78 helps avoid the above inconvenience.

In the first embodiment, the water entering prevention side wall portion 77 preferably surrounds the entirety of the hole periphery of the ambient air introducing hole 76 and is therefore formed in the tubular shape, and the vent hole 76*a* is provided on the upper side of the half portion of the tubular shape of the water entering prevention side wall portion 77 that is located on the inner side (which is opposite to the direction of the arrow R) in the radial direction of the partition wall. The reason is that the above structure prevents, even when water reaches a lower side of the half portion of the tubular shape of the water entering prevention side wall portion 77, the water from entering the ambient air introducing hole 76.

In the first embodiment, the ambient air introducing hole 76 is preferably located radially outward of the suspended tubular portion 24, and the vent hole 76*a* is preferably located above a lower end of the suspended tubular portion 24, because by doing so, a waterdrop that has attached to an inner surface of the suspended tubular portion 24 is prevented from entering the vent hole 76*a*.

(Second Embodiment)

FIGS. 5-8 show a foam dispenser 200 according to a second embodiment of the present invention. In the second embodiment, the same or similar components as or to those in the first embodiment are denoted by the same reference numerals, to eliminate superfluous description.

In the second embodiment, a lower portion 21*a* of the placing tubular portion 21 is fitted to the neck 12, and an upper portion 21*b* of the placing tubular portion 21 is extended up above the neck 12. In accordance with a longitudinal length of the upper portion 21*b*, the length of the water entering prevention side wall portion 77 is ensured to be sufficient. The length of the fitting tubular portion 25 is also long in accordance with the upper portion 21*b*. The upper portion 21*b* of the placing tubular portion 21 is smaller than the lower portion 21*a* in outer diameter.

In the second embodiment, the head circumferential wall 84 of the depression head 80 and the spacer S are omitted. Instead, the second embodiment provides an overcap D covering the depression head 80 such that a lower end portion of the overcap D is fitted over the upper portion 21*b*.

In the second embodiment, the standing tubular portion 23 of the placing member 20 is omitted, and the flange hole 26 of the inwardly directed flange-shaped top wall portion 22 is in abutment with an outer surface of the coupling tubular portion 82. As shown by the dotted line in FIG. 6, a convex ridge 85 and a concave groove 27 that are engaged with each other may be longitudinally provided for alignment on the outer surface of the coupling tubular portion 82, an inner periphery of the flange hole 26, and the inner surface of the suspended tubular portion 24.

Figure 7:
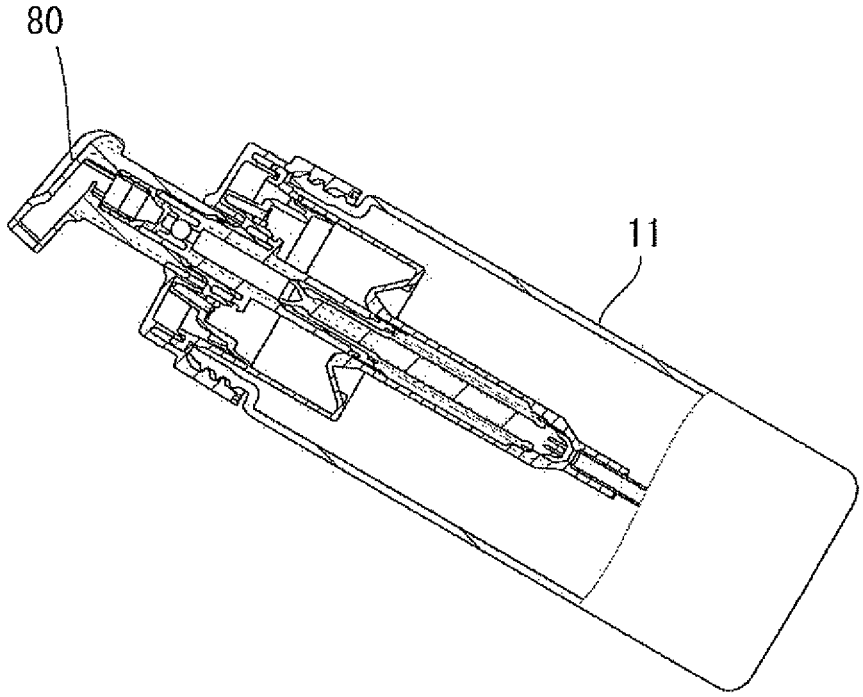
FIG. 7 shows the foam dispenser shown in FIG. 5 in a state where it is tilted during use.
Figure 8:
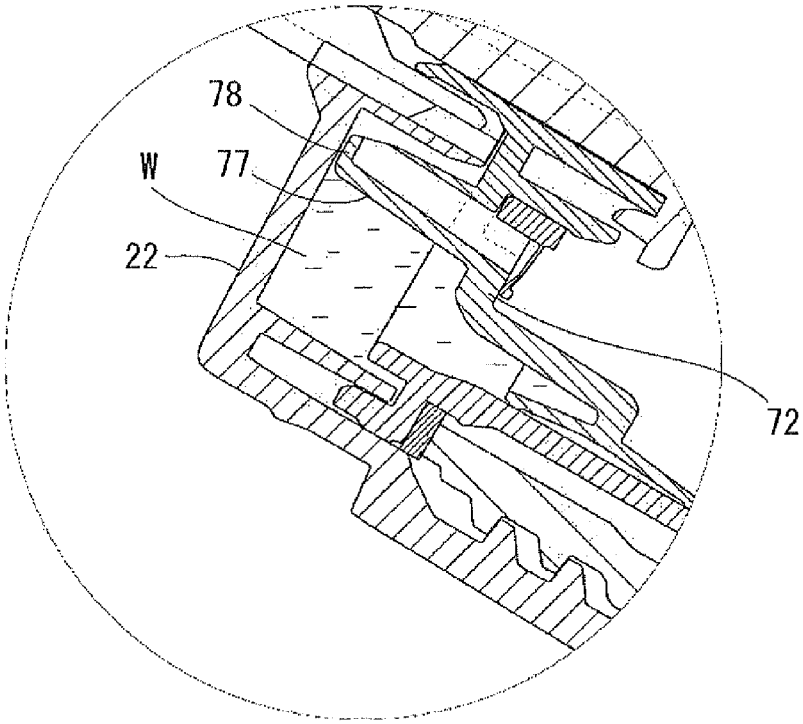
FIG. 8 is a partially enlarged view of the foam dispenser in the state shown in FIG. 7.

Like in the first embodiment, the water entering prevention side wall portion 77 of the second embodiment prevents, when the foam dispenser 200 is tilted as shown in FIGS. 7 and 8, entering of water W collected in the lowered portion within the gap between the partition wall 72 and the inwardly directed flange-shaped top wall portion 22 into the ambient air introducing hole 76.

(Third Embodiment)

Figure 9:
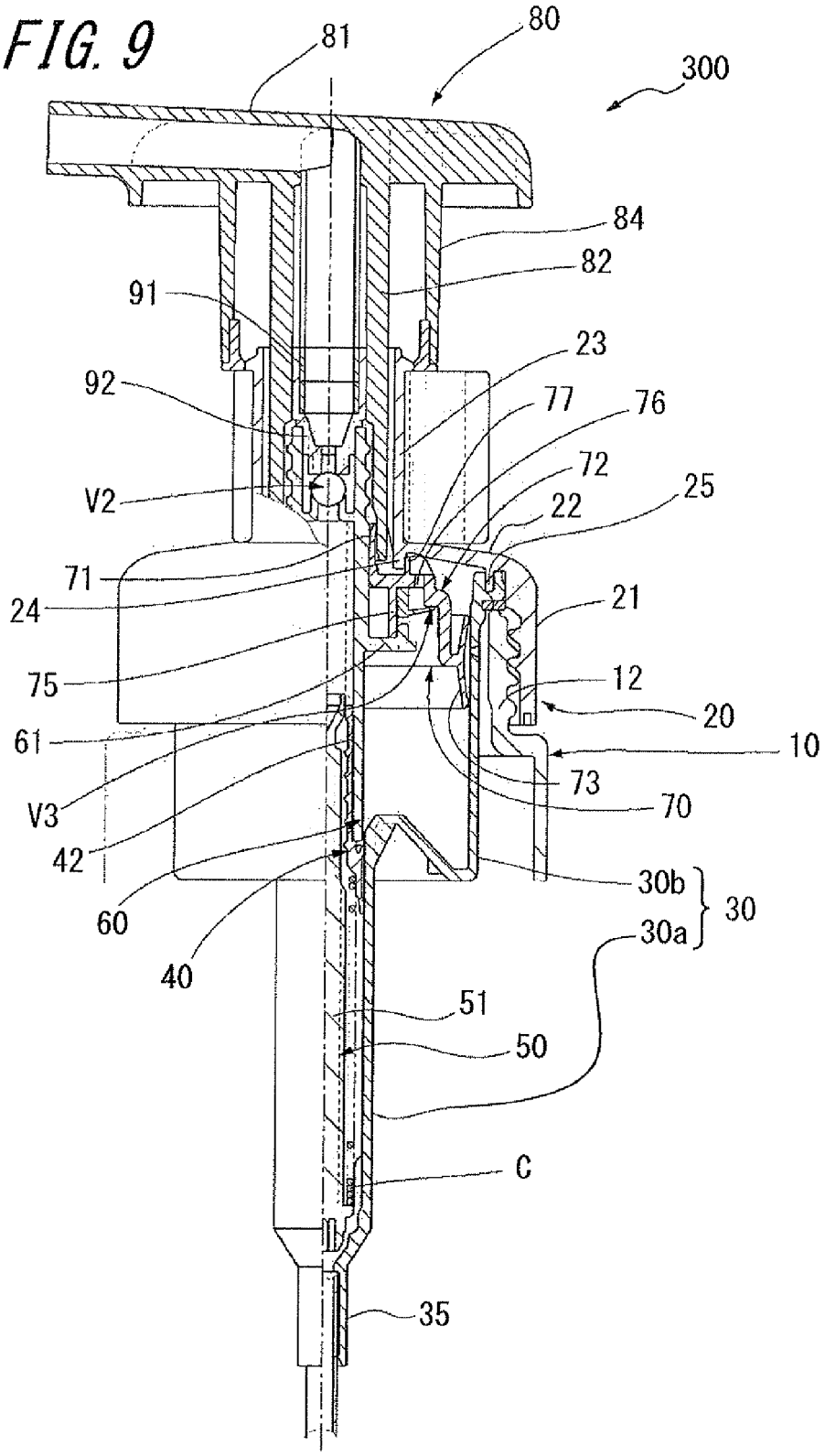
FIG. 9 is a half longitudinal sectional view of the foam dispenser according to a third embodiment of the present invention.
Figure 10:
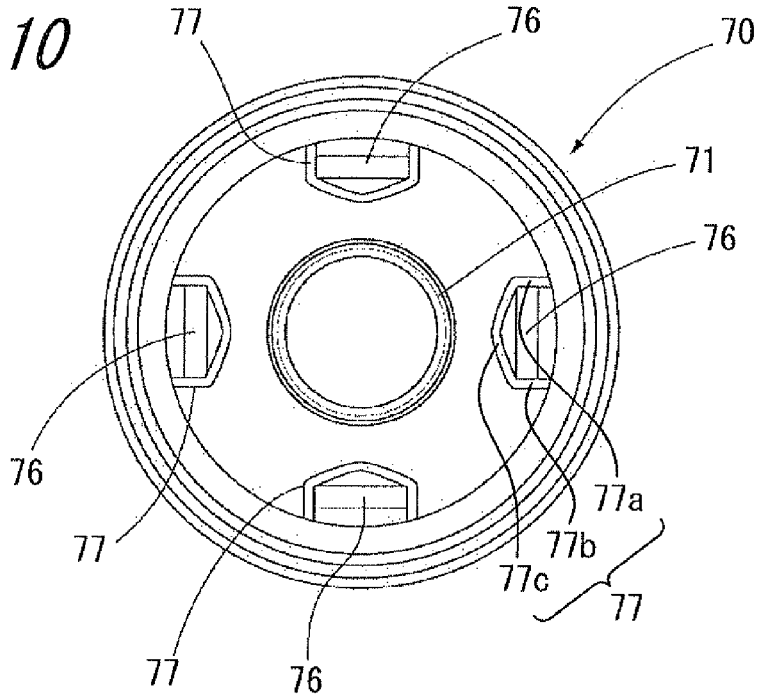
FIG. 10A is a plan view of an air piston shown in FIG. 9.
FIG. 10B is a half sectional front view of the air piston shown in FIG. 9.
Figure 10:
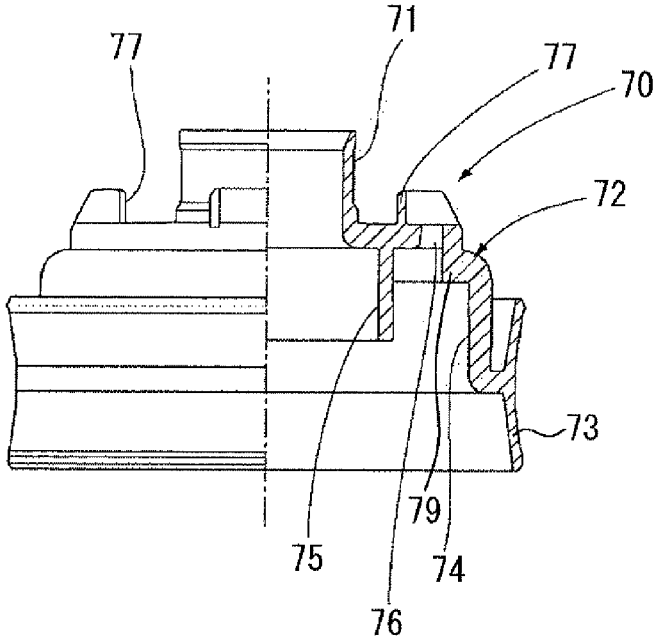
Figure 11:
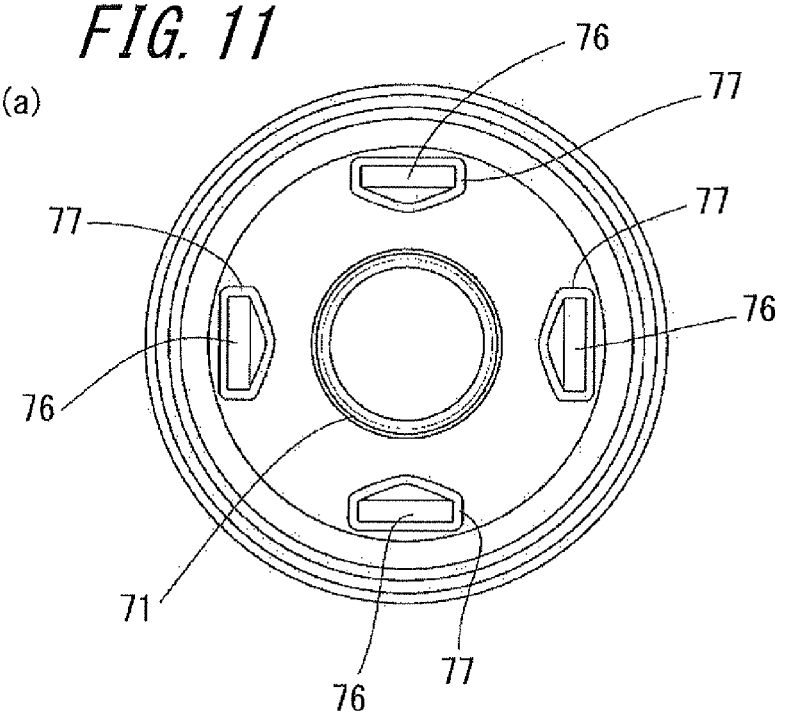
FIG. 11A is a plan view of another air piston.
FIG. 11B is a half sectional front view of the other air piston.
Figure 11:
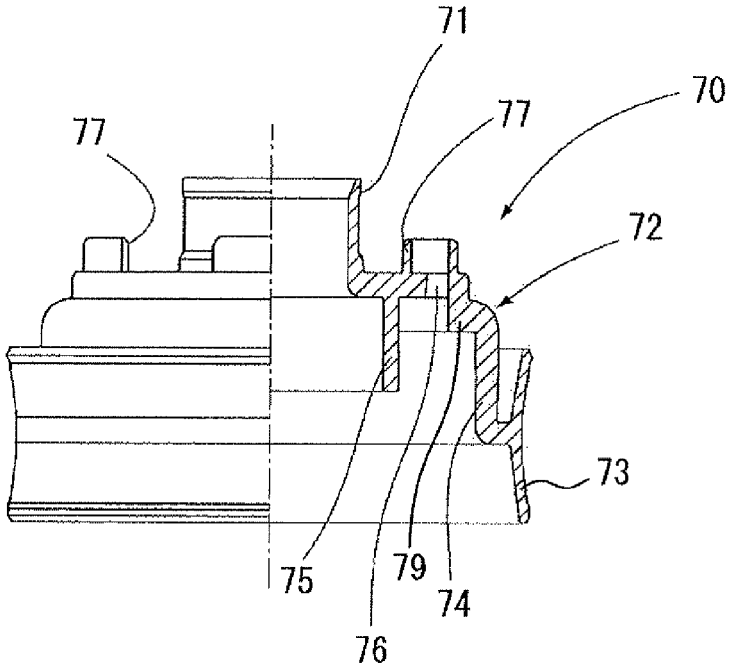

FIGS. 9-11 show a foam dispenser 300 according to a third embodiment of the present invention. In the third embodiment, the same or similar components as or to those in the first and the second embodiment are denoted by the same reference numerals, to eliminate superfluous description.

In the third embodiment, the partition wall 72 extends from the lower end portion of the sliding tubular portion 71 to the middle portion of the air piston 73 in the vertical direction thereof. As shown in FIG. 10, the ambient air introducing holes 76 are disposed at equal intervals in an outer circumferential portion of a flat portion (i.e. top surface wall) of the partition wall 72 that is radially outward of the sliding tubular portion 71. The ambient air introducing holes 76 have a shape prolonged in the circumferential direction of the partition wall 72.

In the third embodiment, water that has entered the gap between the standing tubular portion 23 and the coupling tubular portion 82 drips from the lower end of the suspended tubular portion 24 onto the partition wall 72, without travelling along the lower surface of the inwardly directed flange-shaped top wall portion 22. In this regard, the presence of the water entering prevention side wall portion 77 standing from the at least a portion of the hole periphery of the ambient air introducing hole 76 prevents entering of water and the like dripping from the suspended tubular portion 24 into the air cylinder portion 30*b* through the ambient air introducing hole 76, because the water entering prevention side wall portion 77 changes a flow of the water and the like to bypass the ambient air introducing hole 76.

In the third embodiment, a lower end of the standing tubular portion 23 is preferably extended to form the suspended tubular portion 24, and the ambient air introducing hole 76 is preferably disposed radially outward of the suspended tubular portion 24, because by doing so, the waterdrop that has attached to the inner surface of the suspended tubular portion 24 is prevented from entering the vent hole 76*a*.

In the third embodiment, the water entering prevention side wall portion 77 is formed in a substantially C-shape in the entirety of the hole periphery of the ambient air introducing hole 76 except for a portion of the hole periphery on the outer side in the radial direction of the partition wall 72. That is to say, the water entering prevention side wall portion 77 includes water entering prevention side wall sub-portions 77*a*, 77*b*, and 77*c*, thus surrounding three sides of the ambient air introducing hole 76. The above structure is preferable because the effect of preventing entering of water and the like into the ambient air introducing hole 76 is improved.

Furthermore, the water entering prevention side wall sub-portion 77*c* standing from a portion of the hole periphery on an inner side (i.e. inner side in the radial direction of the partition wall 72) has a middle portion (i.e. middle portion in the circumferential direction of the partition wall 72) that is bent toward the suspended tubular portion 24 in a convex shape as seen in a plan view. The above structure is preferable because the flow of water and the like is changed to a direction away from the ambient air introducing hole 76.

Moreover, regarding the water entering prevention side wall sub-portions 77*a* and 77*b* disposed on both sides of the water entering prevention side wall sub-portion 77*c* and facing each other, end portions thereof are extended outward in the radial direction of the partition wall 72 beyond the width of the ambient air introducing hole 76. The above structure is preferable because the effect of preventing entering of water and the like into the ambient air introducing hole 76 is further improved.

Moreover, the ambient air introducing hole 76 is preferably formed in the outer circumferential portion of the top surface wall of the partition wall 72. The reason is that the above structure helps increase a distance between the ambient air introducing hole 76 and the suspended tubular portion 24, and as a result, water and the like that is bounced off is prevented from entering the ambient air introducing hole 76 even when a height of the water entering prevention side wall portion 77 is somewhat small.

Furthermore, the water entering prevention side wall portion 77 is preferably above the lower end of the suspended tubular portion 24, because by doing so, water or the like is prevented from entering the ambient air introducing hole 76.

As shown in FIG. 11, the water entering prevention side wall portion 77 is even more preferably formed to stand around the entirety of the hole periphery of the ambient air introducing hole 76, because by doing so, the effect of preventing entering of water and the like into the ambient air introducing hole 76 is further improved.

REFERENCE SIGNS

10 Container body
11 Trunk
12 Neck
20 Placing member
21 Placing tubular member
21*a* Lower portion

21*b* Upper portion
22 Inwardly directed flange-shaped top wall portion
23 Standing tubular portion
24 Suspended tubular portion
25 Fitting tubular portion
26 Flange hole
27 Concave groove
30 Cylinder
30*a* Liquid cylinder portion
30*b* Air cylinder portion
31 Upper end portion
32 Flange
33 Short tube
34 Reduced-diameter portion
35 Attachment tubular portion
40 First piston member
41 Liquid piston
42 Stem fitting tubular portion
50 Poppet valve body
60 Stem
61 First valve seat portion
62 Second valve seat portion
63 Ball valve
70 Second piston member
71 Sliding tubular portion
72 Partition wall
73 Air piston
74 Outer circumferential wall
75 Inner circumferential wall
76 Ambient air introducing valve
76*a* Vent hole
77 Water entering prevention side wall portion
78 Water entering prevention top wall portion
79 Stepped portion
80 Depression head
81 Top wall
82 Coupling tubular portion
83 Nozzle
84 Head circumferential wall
85 Convex ridge
90 Foaming tube
91 Foaming mesh
92 Jet ring
100 Foam dispenser
200 Foam dispenser
300 Foam dispenser
A Actuator
B Suction tube
C Coil spring
D Overcap
F Packing
S Spacer
P Air passage
R1 First longitudinal rib
R2 Second longitudinal rib
V1 Liquid suction valve
V2 Liquid dispensing valve
V3 Air suction valve
V4 Air dispensing valve
V5 Check valve
W Water

The invention claimed is:

1. A foam dispenser, comprising:

a placing member that includes a placing tubular portion adapted to be fitted to an outer surface of a neck of a container and an inwardly directed flange-shaped top wall portion provided in an upper portion of the placing tubular portion;

a cylinder that includes a lower portion and an upper portion and that is suspended from a lower surface of the inwardly directed flange-shaped top wall portion into the container, the lower portion of the cylinder being formed as a small-diameter liquid cylinder portion and the upper portion of the cylinder being formed as an air cylinder portion, the air cylinder portion having a larger diameter than the small-diameter liquid cylinder portion; and an actuator that includes a liquid piston adapted to slide in the liquid cylinder portion, a stem standing from the cylinder, a ring-shaped partition wall surrounding a middle portion of the stem in a vertical direction thereof, an air piston provided on an outer circumferential portion of the partition wall, and a depression head placed over the stem and including a nozzle, wherein the liquid piston is slidably fitted in the liquid cylinder portion, and the air piston is slidably fitted in the air cylinder portion, and upward and downward displacement of the actuator causes a content liquid within the liquid cylinder portion and air within the air cylinder portion to be mixed and foamed and then dispensed from the nozzle, and the partition wall is provided with an ambient air introducing hole, and from at least a portion of a hole periphery of the ambient air introducing hole, a water entering prevention side wall portion stands for preventing water from entering the ambient air introducing hole, wherein the inwardly directed flange-shaped top wall portion includes a flange hole from which a suspended tubular portion is suspended, and the ambient air introducing hole is provided outward of the suspended tubular portion in the radial direction of the partition wall.

2. The foam dispenser of claim 1, wherein the water entering prevention side wall portion is formed on an outer side of the hole periphery of the ambient air introducing hole in a radial direction of the partition wall, and a vent hole is provided on an inner side in the radial direction.

3. The foam dispenser of claim 1, wherein a water entering prevention top wall portion is attached to an upper end portion of the water entering prevention side wall portion, the water entering prevention top wall portion extending inward in the radial direction of the partition wall in a roof-like shape from the water entering prevention side wall portion as seen in a longitudinal sectional view in a circumferential direction of the ring-shaped partition wall.

4. The foam dispenser of claim 2, wherein the water entering prevention side wall portion is formed in a tubular shape, and the vent hole is provided on an upper side of a half portion of the tubular shape of the water entering prevention side wall that is located on the inner side in the radial direction of the partition wall.

5. The foam dispenser of claim 4, wherein the inwardly directed flange-shaped top wall portion includes a flange hole from which a suspended tubular portion is suspended, and the ambient air introducing hole is provided outward of the suspended tubular portion in the radial direction of the partition wall, and the vent hole is located above a lower end of the suspended tubular portion.

6. The foam dispenser of claim 1, wherein the water entering prevention side wall portion is formed in a C-shape in an entirety of the hole periphery of the ambient air introducing hole except for a portion of the hole periphery that is on the outer side in the radial direction of the partition wall.

7. The foam dispenser of claim 1, wherein the water entering prevention side wall portion is formed in an entirety of the hole periphery of the ambient air introducing hole.

8. The foam dispenser of claim 1, wherein the water entering prevention side wall portion standing from an inner side of the hole periphery of the ambient air introducing hole has a middle portion that is bent toward the suspended tubular portion in a convex shape.

9. The foam dispenser of claim 1, wherein the ambient air introducing hole is formed in an outer circumferential portion of a top surface wall of the partition wall.

10. The foam dispenser of claim 1, wherein an upper end of the water entering prevention side wall portion is located above a lower end of the suspended tubular portion in an uppermost displacement position of the stem.

* * * * *